US005106032A

United States Patent [19]

Tanigawa

[11] Patent Number: 5,106,032

[45] Date of Patent: Apr. 21, 1992

[54] KINK PREVENTING DEVICE FOR WINDER

[75] Inventor: Yasunobu Tanigawa, Kyoto, Japan

[73] Assignee: Murata Kikai Kabushiki Kaisha, Kyoto, Japan

[21] Appl. No.: 591,464

[22] Filed: Oct. 1, 1990

[30] Foreign Application Priority Data

Oct. 5, 1989 [JP] Japan ..... 1-117344[U]

[51] Int. Cl.[5] ..... B65H 49/02

[52] U.S. Cl. ..... 242/128; 242/35.5 R; 242/35.6 R

[58] Field of Search ..... 242/128, 35.6 R, 35.5 R, 242/18 R, 54 R; 57/352, 354

[56] References Cited

U.S. PATENT DOCUMENTS 4,552,320 11/1985 Wust ..... 242/128
4,673,138 6/1987 Ichiba ..... 242/35.5 R

FOREIGN PATENT DOCUMENTS 0275596 7/1988 European Pat. Off. ..... 242/35.6 R
216869 12/1983 Japan ..... 242/35.6 R

*Primary Examiner*—Stanley N. Gilreath
*Attorney, Agent, or Firm*—Spensley Horn Jubas & Lubitz

[57] ABSTRACT

A kink preventing device which is made such that a cylindrical kink preventive member having a conical part expanded downwardly is arranged over the yarn feeding bobbin in such a way it may be moved up or down.

8 Claims, 4 Drawing Sheets

KINK PREVENTING DEVICE FOR WINDER

FIELD OF THE INVENTION

The present invention relates to a kink preventive device for a winder so as to prevent a kink from being produced at the yarn end guided from the bobbin side to the yarn joining device when the yarns are to be joined.

RELATED ART STATEMENT

In an automatic winder, when the yarn feeding bobbin is to be replaced or when the yarn is cut, a lower yarn at the bobbin and an upper yarn at a package are sucked by suction pipes, respectively and they are guided to the yarn joining device. Since the lower yarn at the bobbin is released from the bobbin under no tension, a so-called kink, in which the yarn end is shrunk in a loop form is generated in case of a highly twisted yarn. Where this kinky yarn is generated, there may be produced some disadvantages such that a poorly yarn joining is produced or the poor joined portion having a kink mixed in the package is wound up.

In view of the foregoing, there has been provided a kink preventing countermeasure as described below. For example, Jap. Pat. Laid-Open No. Sho 58-216869 has proposed that as shown in FIG. 6, a plate or a rod-like kink preventing member 21 is oscillatably contacted with one side of a head part 1*a* where yarn layer 2 of the yarn feeding bobbin 1 is not present. That is, this kink preventing member 21 contacts with the bobbin head part 1*a* when the yarns are to be joined, thereby wherein a yarn Y released from the yarn layer 2 is restricted by the kink preventing member 21 and thus a proper tension for preventing the kink can be applied to the yarn Y sucked and guided by the yarn joining device.

A problem with the aforesaid countermeasure is that the bobbin head 1*a* contacts the kink preventing member 21. As a result, only at one side thereof. As a result, when the yarn Y passes through a free zone around it, a releasing tension may not be effectively applied.

In view of the above, there has been proposed a kink preventing device to eliminate the aforesaid disadvantage. As shown in FIG. 7, this device is constructed such that a pair of rod-like kink preventing members 22*a* and 22*b* curved in a semi-circular shape are arranged around the bobbin head 1*a* in such a way as they may be opened or closed. The kink preventing members 22*a* and 22*b* are closed at both sides of the bobbin head 1*a* when the yarns are to be joined and held at its entire circumference.

However, the aforesaid improved kink preventing device has the following disadvantages.

Although the kink preventing members 22*a* and 22*b* are designed to form a ring while being closed, it is difficult to make the ring fit uniformly around an entire circumference of the top part 1*a* of the bobbin. This non-contacted portion may easily be generated near the yarn. The problem of a poor contact may become more remarkable in the case where a diameter of the yarn feeding bobbin 1 or an opening or closing position of the kink preventing members 22*a* and 22*b* shows a relative displacement with respect to the center of the bobbin 1.

OBJECT AND SUMMARY OF THE INVENTION

An object of the present invention is to provide an apparatus for preventing kinks in yarns in which the aforesaid poor contact is eliminated to increase a positive characteristic of an effect of preventing an occurrence of kinked yarns. A further object is the attachment of uniform conditions on the bobbin and the avoidance of variations in bobbin conditions such as the outer diameter of the bobbin.

The kink preventing apparatus of the present device is made such that a cylindrical kink preventive member having a conical part expanded downwardly is arranged over the yarn feeding bobbin in such a way as it may be moved up or down.

As the aforesaid kink preventive member is lowered from the waiting position above the yarn feeding bobbin, the bobbin head is contacted with an inner circumferential surface of the conical member and then stopped. At this time, the bobbin head may provide an annular linear contacting state against the inner circumferential surface of the conical part. Thus, the yarn passing through this contact part and released through it is always applied with a tension force for preventing an occurrence of kinky yarn. Even if an outer diameter of the yarn feeding bobbin is varied, the aforesaid linear contacted state is kept as long as the bobbin can be loaded at the conical part of the kink preventive member. In addition, if the kink preventive member is supported in such a way as it may be moved in a horizontal direction, it may provide such an action as one in which the kink preventive member may follow the bobbin head even if the kink preventive member may generate a displacement in respect to the center of the bobbin and then the axial displacement between both members is accommodated.

DETAILED DESCRIPTION OF PREFERRED EMBODIMENT

One preferred embodiment of the present invention will be described in reference to the drawings.

Figure 5:
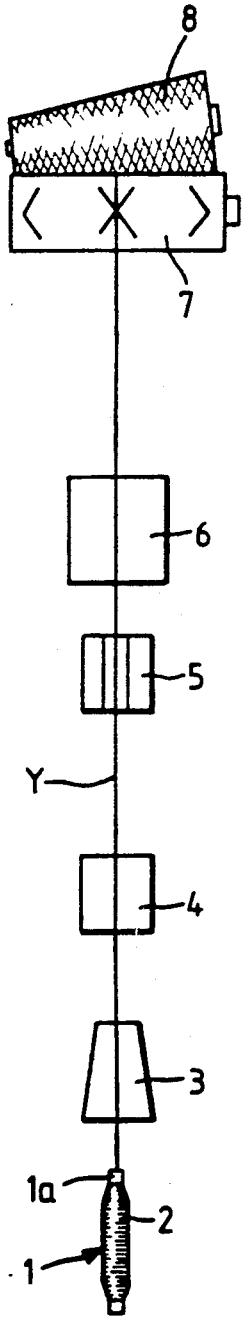
FIG. 5 is a schematic front elevational view for showing a yarn feeding path of a winder on which the kink preventive device is mounted.
Figure 6:
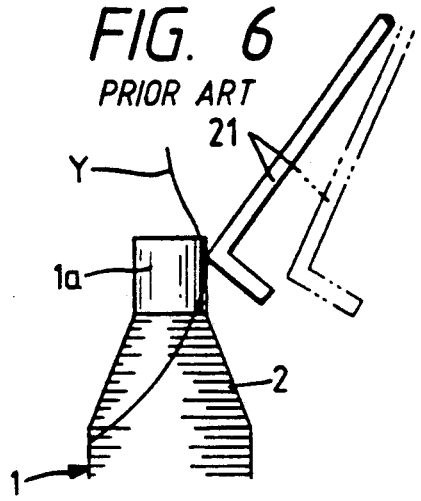
FIG. 6 PRIOR ART
FIG. 6 is a partial side elevational view for showing the kink preventive device to show a prior art example.
Figure 7:
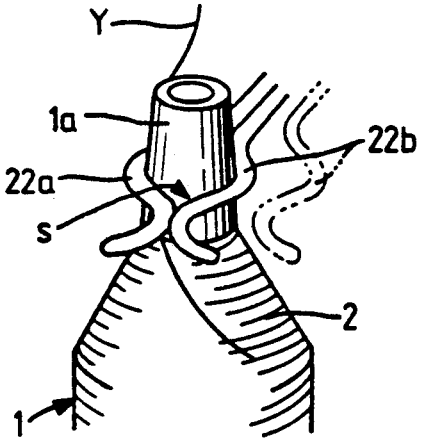
FIG. 7 PRIOR ART
FIG. 7 is a partial perspective view for showing an improved prior art example.

At first, FIG. 5 shows a schematic view of a yarn feeding path for a winder for use in taking up the yarn layer 2 wound around the yarn feeding bobbin 1 and then winding it onto a package 8. That is, a yarn Y drawn from the yarn feeding bobbin 1 such as a bobbin or the like supplied to a winding unit passes through a balloon breaker 3, a tension device 4, a yarn fault inspection head 5 and a yarn joining device 6 or the like and then the yarn is taken up by the package 8 rotated by an upper yarn traversing drum 7. The aforesaid balloon breaker 3 may restrict the yarn Y moved away from the yarn layer 2 of the yarn feeding bobbin 1 from making a balloon and it is installed just over the bobbin 1 in such a way as the yarn Y is inserted into it.

Figure 1:
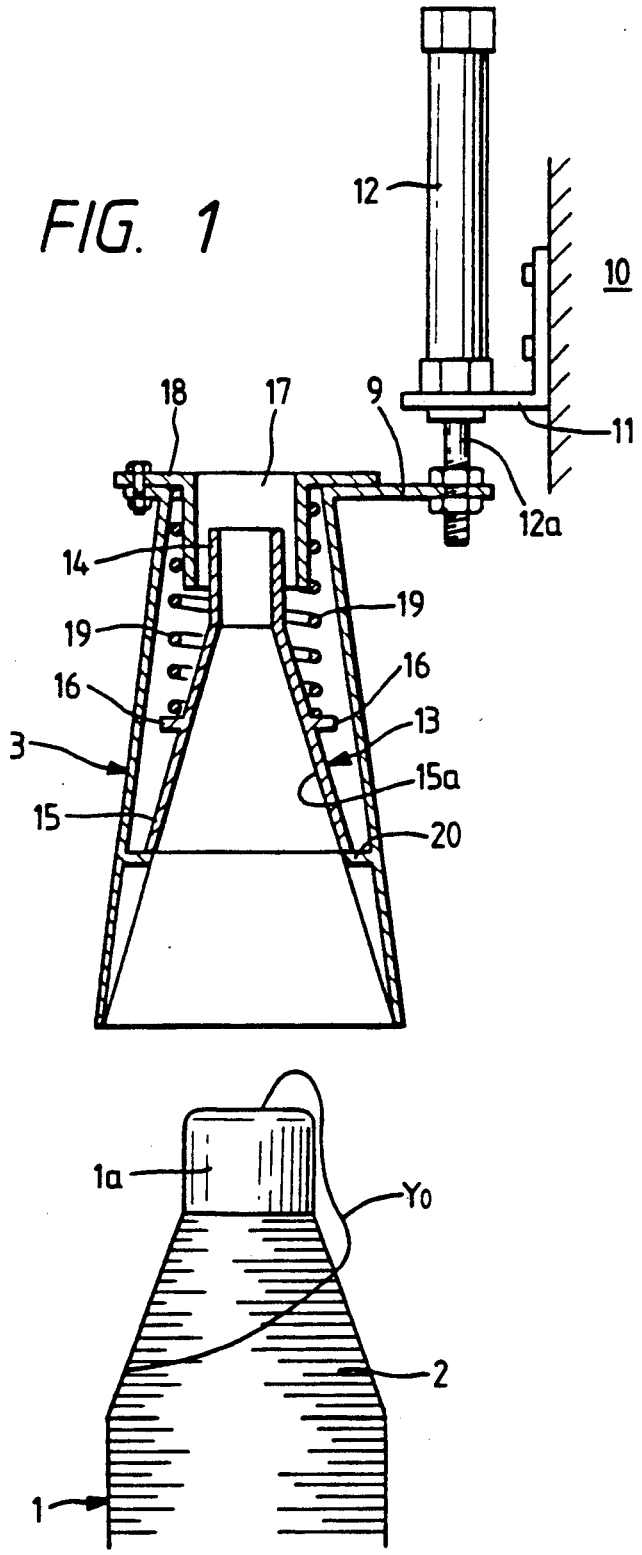
FIG. 1 is a sectional view for showing a kink preventive device of one preferred embodiment of the present invention.

The kink preventive device illustrated in FIG. 1 is constructed as a balloon breaker type cooperating with a balloon breaker 3.

The balloon breaker 3 is formed as a cylinder expanded to open downwardly and then a supporting piece 9 is projected in a horizontal direction from one side of its upper end. Then, the balloon breaker 3 is supported by a frame 10 of a winding unit together with the kink preventive member to be described later in such a way as it may be moved up or down. That is, An air cylinder 12 is supported on the frame 10 via a bracket 11 in such a way as it faces vertically. The supporting piece 9 is fixedly supported at an extreme end of the cylinder rod 12*a* extending vertically from the air cylinder 12. The balloon breaker 3 is cooperated with an extending or retracting operation of the air cylinder 12 and moved up and down above the yarn feeding bobbin 1 to be supplied to a concentric position therebelow.

A cylindrical kink preventive member 13 of the present device is installed within the balloon breaker 3. The kink preventive member 13 is formed entirely as an inverted funnel-like cylinder member having a cylinder part 14 at its upper part and a conical part 15 expanded downwardly from the cylinder part 14 at the lower part thereof. The kink preventive member 13 is installed in such a way as it may be axially moved up or down in the breaker 3 and further displaced in a horizontal direction. This arrangement will be described in detail, wherein a cylindrical guide 17 having a base flange part 18 fixed to the opening end of the balloon breaker 3 is concentrically inserted above and inside the balloon breaker 3. The kink preventive member 13 is inserted into the cylindrical guide 17 from a lower part of it in such a way as its upper cylinder part 14 is freely fitted to it. The kink preventive member 13 is hung at the cylindrical guide 17 with a spring 19 by installing each of the ends of the spring between a lower surface of the base flange 18 of the cylindrical guide 17 and an upper surface of a spring receptor 16 projected from an outer circumference of the conical part 15. In this way, the kink preventive member 13 can be axially moved up and down within the balloon breaker 3 through an expansion or retraction movement of the spring 19 and further it is applied with a degree of freedom of horizontal displacement corresponding to a clearance of the upper cylinder 14 in respect to the inner circumference of the cylindrical guide 17.

As the aforesaid spring 19, a spring having a spring force adjusted to force the kink preventive member 13 quite lightly toward a lower part is used and in turn the kink preventive member 13 biased by this spring 19, under a waiting condition shown in FIG. 1, is engaged in a stable manner with the lower end of the conical part 15 being abutted against a stopper 20 projected at the inner circumference of the balloon breaker 3.

Then, operation of this device will be described.

Figure 2:
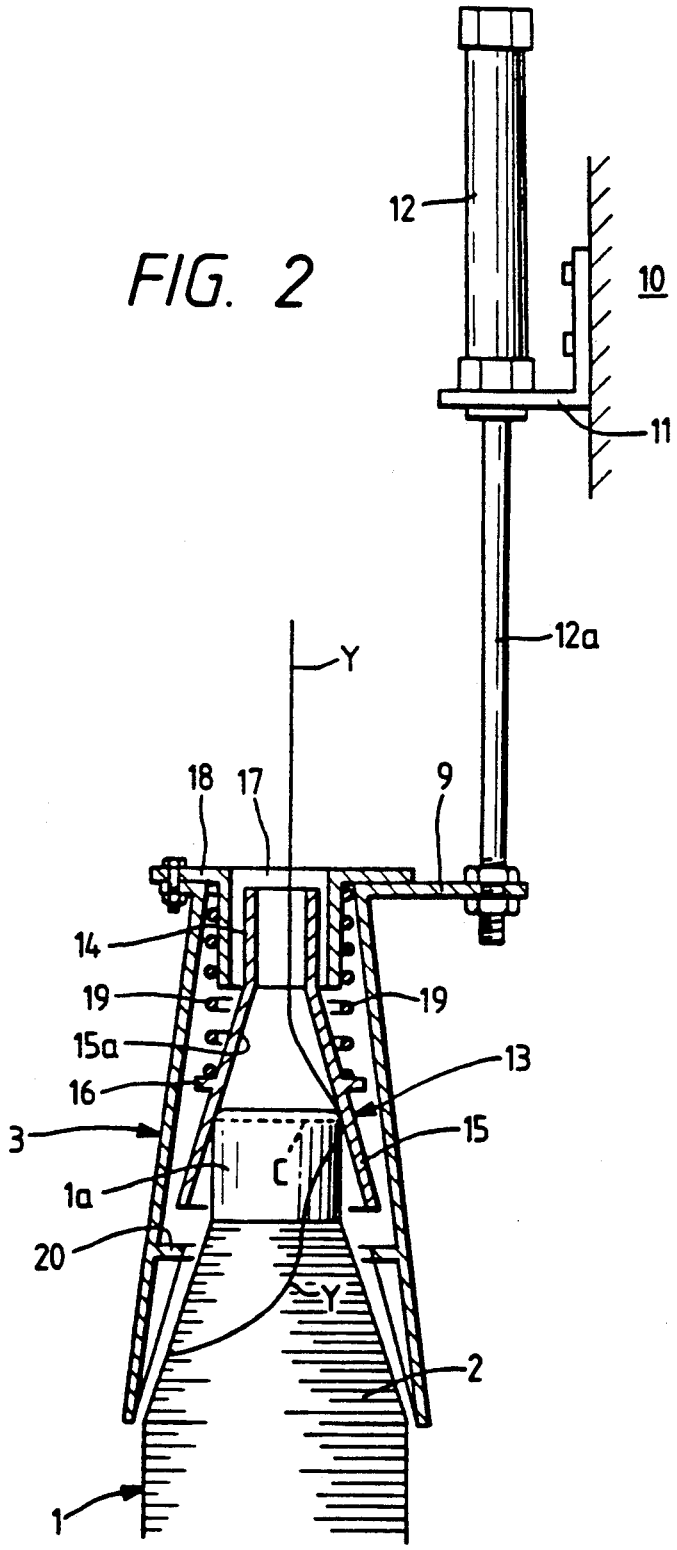
FIG. 2 is a sectional view for showing an operation of the present invention.

In FIG. 1 is also illustrated a manner in which the yarn feeding bobbin 1 is supplied while a yarn end Yo released from the yarn layer 2 is being inserted into an axial bore of the bobbin head 1*a*, i.e. under a yarn leading condition. In FIG. 2 the yarn end Yo is connected to an upper yarn of the package not shown from the former state. That is, air is blown from the state shown in FIG. 1 into the axial bore of the yarn feeding bobbin 1 so as to blow up the yarn end Y as shown in FIG. 2. After this operation, the air cylinder 12 is elongated to drop the balloon breaker 3 to a predetermined lowering position. Then, during its descending operation, the kink preventive member 13 is stopped in advance while the bobbin head 1*a* being contacted with the inner circumferential surface 15*a* of the conical part 15 and in subsequent thereto, it may lift up relatively within the balloon breaker 3 until the balloon breaker reaches its dropped position.

Then, under this dropped condition, as shown in FIG. 2, a contact part (indicated by a broken line) C where the bobbin head 1*a* is contacted with the inner circumferential surface 15*a* of the conical part 15 may show a line contacted state connected in an annular form at the same height and further an appropriate contact pressure applied by the compressed and deformed spring 19 is uniformly applied from the kink preventive member 13 to the aforesaid annular contact part C.

Thus, if the yarn end Y blown up under this condition is sucked up and held by a suction pipe and guided to a yarn joining device, a requisite tension is always applied to the yarn Y passing through the annular contact part C between the bobbin head 1*a* and the kink preventive member 12 irrespective of a phase of the yarn Y released from the yarn layer 2, resulting in that an effect of positive kinky yarn prevention can be attained. After yarn joining, the kink preventive member 13 is returned back to the waiting position shown in FIG. 1 together with the balloon breaker 3 in simultaneous with a starting of winding into the package.

Figure 3:
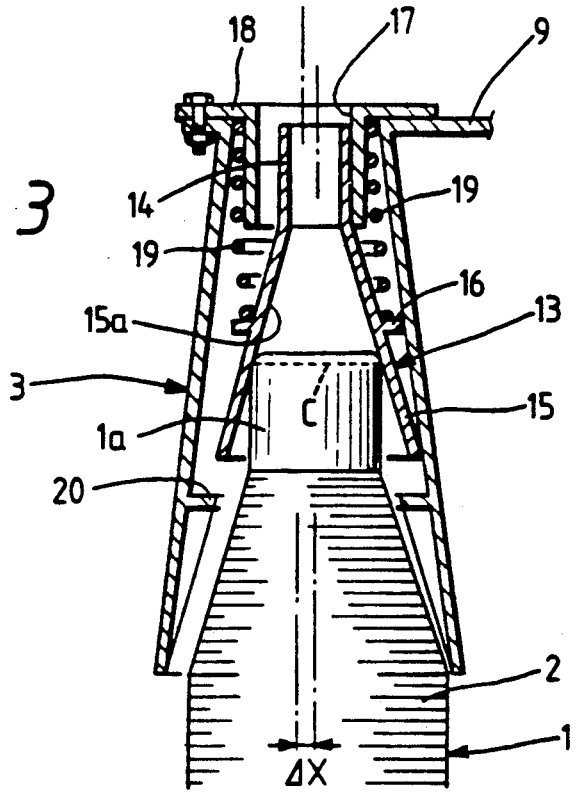
FIG. 3 is a sectional view for showing a substantial part of the device to illustrate an action of the preferred embodiment.
Figure 4:
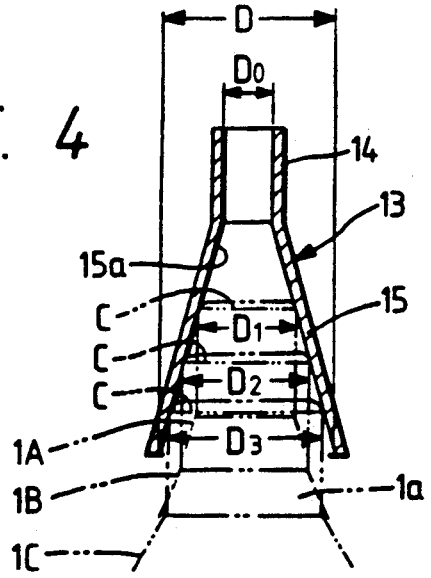
FIG. 4 is an illustrative view for showing similarly a substantial part to show the action.

In the present device, as described above, it has the feature that a positive kinky yarn prevention can be attained during yarn joining and further as shown in FIGS. 3 and 4, it shows a universal applicability for a variation of a condition of the bobbin.

Although FIG. 3 illustrates a case in which the yarn feeding bobbin 1 and the balloon breaker 3 are relatively displaced at their centers to each other by an amount $\Delta X$, even under this condition, the kink preventive member 13 is installed to be displaceable in a horizontal direction in the present device, resulting in that if the inner circumferential surface 15*a* of the conical part is contacted from one side thereof to the bobbin head 1*a*, and the kink preventive member 13 is displaced to follow the yarn feeding bobbin 1 and the axial displacement $\Delta X$ between both members is automatically accommodated.

FIG. 4 illustrates a contacted state of the kink preventive member 13 against bobbins 1A, 1B and 1C having different diameters. That is, as long as the outer diameters ($D_1$, $D_2$ and $D_3$) of the bobbin head 1*a* are within the inner diameters ($D_0$ to D) of the conical part 15, each of the bobbin heads 1*a* is formed with the aforesaid annular contact part C.

Although the kink preventive device using the balloon breaker together has been described, the cylindrical kink preventive member of the present invention can be arranged without having any relation with the breaker. However, if the present invention is used with the balloon breaker, a kink preventive member fixing structure or the like can be simplified and a rational configuration of system can be realized.

As described above, in case of the present device, the cylindrical kink preventive member having a conical part is arranged in such a way as it may be moved up or down, resulting in that the kink preventive member can be contacted with the entire circumference of the bobbin head part and further a tension force can be always applied to the yarn end guided to the yarn joining device and an occurrence of the kinky yarn during yarn joining can be positively prevented. The present device has an advantage that a universal applicability can be assured even if a bobbin condition to which the kink preventive member may act, such as an outer diameter of the yarn feeding bobbin or the like is varied.

What is claimed is:

1. A kink preventing apparatus for a winder comprising:

a movable kink preventive member having a conically shaped portion opposingly arranged with a head portion of a yarn feeding bobbin, and moving means for moving the kink preventive member between first and second positions, wherein the conically shaped portion of the kink preventive member surrounds and contacts an outer circumferential surface of the head portion in the first position and is spaced from the head portion in the second position.

2. A kink preventing apparatus according to claim 1 including a balloon breaker, wherein the kink preventive member is disposed within the balloon breaker.

3. A kink preventing apparatus according to claim 2, including means for movably disposing the kink preventive member within the balloon breaker such that it may be moved in axial and radial directions with respect to a center axis of the balloon breaker.

4. A kink preventing apparatus according to claim 3, wherein the means for movably disposing includes a cylindrical guide having a base flange portion fixed to an open end of the balloon breaker, wherein the kink preventive member includes a cylindrical portion which is inserted into the cylindrical guide from a yarn feeding bobbin side of the cylindrical guide, wherein the cylinder portion of the kink preventive member is movably fitted within the cylindrical guide.

5. A kink preventing device as claimed in claim 4, the means for movably disposing including a spring receptor projecting from an outer circumferential surface of the conically shaped portion of the kink preventive member, a stopper projecting from an inner circumferential surface of the balloon breaker for supporting the conically shaped portion of the kink preventive member, and a spring disposed between the base flange portion of the cylindrical guide and the spring receptor, wherein the spring applies a bias force against the kink preventive member to movably bias the kink preventive member against the stopper, the kink preventive member remaining axially and radially movable with respect to the center axis of the balloon breaker.

6. A kink preventing device according to claim 2, wherein the moving means comprises an air cylinder including a piston extending from the air cylinder and securably attached to an outer surface of the balloon breaker.

7. A kink preventing apparatus according to claim 1, wherein yarn being supplied from the yarn feeding bobbin passes between the head portion and the conically shaped portion of the kink preventive member.

8. A kink preventing device according to claim 7, wherein the conically shaped portion of the kink preventive member includes an inner circumferential surface, and wherein the moving means is operative to move the kink preventive member to the first position such that the inner circumferential surface contacts the outer circumferential surface of the head portion.

* * * * *